US006294506B1

(12) United States Patent
Friesen et al.

(10) Patent No.: US 6,294,506 B1
(45) Date of Patent: Sep. 25, 2001

(54) LUBRICATING OILS HAVING CARBONATED SULFURIZED METAL ALKYL PHENATES AND CARBONATED METAL ALKYL ARYL SULFONATES

(75) Inventors: Terry V. Friesen; James J. Harrison, both of Novato; William R. Ruhe, Jr., Benicia, all of CA (US)

(73) Assignee: Chevron Chemical Company, San Ramon, CA (US)

( * ) Notice: Subject to any disclaimer, the term of this patent is extended or adjusted under 35 U.S.C. 154(b) by 0 days.

(21) Appl. No.: 08/275,860

(22) Filed: Jul. 15, 1994

Related U.S. Application Data

(63) Continuation-in-part of application No. 08/028,433, filed on Mar. 9, 1993, now Pat. No. 5,334,321.

(51) Int. Cl.[7] ..... C10M 133/16

(52) U.S. Cl. ..... 508/287; 508/391; 508/577; 508/583

(58) Field of Search ..... 252/18, 25, 33.2, 252/42.7, 39, 40, 51.5 A

(56) References Cited

U.S. PATENT DOCUMENTS

| | | | |
|---|---|---|---|
| 2,992,708 | 7/1961 | Lyon | 188/264 |
| 3,018,250 | 1/1962 | Anderson et al. | 252/51.5 |
| 3,018,291 | 1/1962 | Anderson et al. | 260/326.5 |
| 3,024,195 | 3/1962 | Drummond et al. | 252/51.5 |
| 3,024,237 | 3/1962 | Drummond et al. | 260/268 |
| 3,089,850 | 5/1963 | McConnell et al. | 252/32.7 |
| 3,100,673 | 8/1963 | Ulmer et al. | 8/22 |
| 3,102,096 | 8/1963 | Nygaard et al. | 252/32.7 |
| 3,172,892 | 3/1965 | Le Suer et al. | 260/326.5 |
| 3,178,368 | 4/1965 | Hanneman | 252/33.4 |
| 3,215,707 | 11/1965 | Rense | 260/326.3 |
| 3,219,666 | 11/1965 | Norman et al. | 260/268 |
| 3,231,587 | 1/1966 | Rense | 260/346.8 |
| 3,236,770 | 2/1966 | Matson et al. | 252/32.7 |
| 3,272,746 | 9/1966 | Le Suer et al. | 252/47.5 |
| 3,293,181 | 12/1966 | Stuart | 252/32.7 |
| 3,489,682 | 1/1970 | Lesuer | 252/32.7 |
| 3,515,669 | 6/1970 | Le Suer | 252/39 |
| 3,579,450 | 5/1971 | Lesuer | 252/56 |
| 3,808,142 * | 4/1974 | Crocker | 252/40.7 |
| 3,912,764 | 10/1975 | Palmer, Jr. | 260/346.8 |
| 4,123,369 | 10/1978 | Miller et al. | 252/32.7 E |
| 4,131,551 | 12/1978 | Thompson et al. | 252/33 |
| 4,152,499 | 5/1979 | Boerzel et al. | 526/52.4 |
| 4,283,294 * | 8/1981 | Clarke | 252/32.7 R |
| 4,328,111 | 5/1982 | Watson et al. | 252/33.4 |
| 4,388,471 | 6/1983 | Wollenberg | 549/255 |
| 4,450,281 | 5/1984 | Wollenberg | 549/255 |
| 4,584,117 * | 4/1986 | Wollenberg | 252/51.5 A |
| 4,605,808 | 8/1986 | Samson | 585/525 |
| 4,927,551 | 5/1990 | Erdman et al. | 252/42.7 |

(List continued on next page.)

FOREIGN PATENT DOCUMENTS

| | | | |
|---|---|---|---|
| 0552892A1 | 7/1993 | (EP) | C10M/163/00 |
| 0662508A2 | 7/1995 | (EP) | C10M/159/20 |
| 2014251 | 4/1970 | (FR) | C10M/3/00 |

*Primary Examiner*—Margaret Medley
*Assistant Examiner*—Cephia D. Toomer
(74) *Attorney, Agent, or Firm*—Walter L. Stumpf; Ernest A. Schaal

(57) ABSTRACT

A lubricating oil composition has a major amount of an oil of lubricating viscosity, a minor amount of a carbonated sulfurized metal alkyl phenate and, a minor amount of a carbonated metal alkyl aryl sulfonate. The total base equivalents donated by the phenate is more than 85% of the total base equivalents donated by the phenate and sulfonate. The composition also has alkenyl or alkyl succinimide additives that are the reaction product of a high molecular weight alkenyl- or alkyl-substituted succinic anhydride and a polyalkylene polyamine having an average of greater than four nitrogen atoms per mole, wherein the reaction product is post-treated with a cyclic carbonate.

5 Claims, 1 Drawing Sheet

U.S. PATENT DOCUMENTS

| | | | | |
|---|---|---|---|---|
| 4,938,881 | | 7/1990 | Ripple et al. | 252/32.7 |
| 5,071,576 | * | 12/1991 | Vernet et al. | 252/33.4 |
| 5,112,507 | | 5/1992 | Harrison | 252/51.5 A |
| 5,132,033 | | 7/1992 | Jao et al. | 252/33 |
| 5,202,036 | | 4/1993 | Ripple et al. | 252/33.4 |
| 5,262,073 | * | 11/1993 | Schmitt et al. | 252/33.2 |
| 5,334,321 | * | 8/1994 | Harrison et al. | 252/51.5 A |
| 5,370,805 | | 12/1994 | Smrcka et al. | 252/42.7 |

* cited by examiner

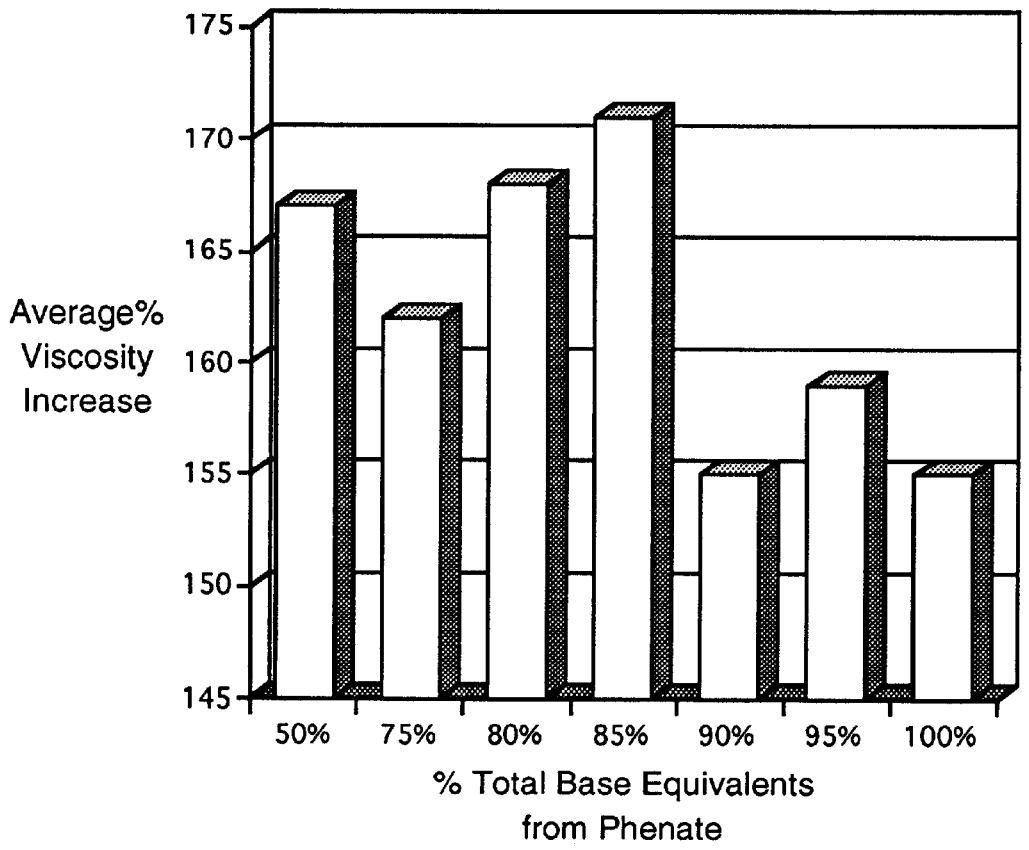
175
170
165
160
155
150
145
Average%
Viscosity
Increase
50%
75%
80%
85%
90%
95%
100%
% Total Base Equivalents
from Phenate

LUBRICATING OILS HAVING CARBONATED SULFURIZED METAL ALKYL PHENATES AND CARBONATED METAL ALKYL ARYL SULFONATES

This application is a C-I-P of Ser. No. 08/028,433, filed Mar. 9, 1993, now U.S. Pat. No. 5,334,321.

BACKGROUND OF THE INVENTION

Viscosity increase due to soot accumulation in the oil can cause severe damage to diesel engines as a result of slow drainage of oil back to the sump, gelation of the oil in the sump, or filter plugging, all of which can result in reduced oil flow to critical bearings and oil-cooled parts, such as pistons.

Rust inhibition is also a key performance parameter for lubricating oils. Poor rust inhibiting properties can result in stuck valve lifters, impairing the operation of the engine.

Sulfurized, carbonated, calcium alkylphenates are well known detergents for lubricating oils, including heavy duty diesel crankcase applications. They provide certain advantages over other types of metallic detergents, specifically sulfonates, in that they impart oxidation protection to the lubricating oil. Unfortunately, formulations based solely on sulfurized, carbonated, calcium alkylphenates as the overbased detergent are deficient in rust inhibition, and are usually formulated with special rust inhibitors. These inhibitors add cost to the formulation and can sometimes cause compatibility problems with the other additives in the lubricating oil formulation.

We have discovered that a certain combination of a carbonated sulfurized metal alkyl phenate and a carbonated metal alkyl aryl sulfonate gives both good soot dispersancy and good rust inhibition.

U.S. Pat. No. 3,236,770 teaches a diesel lubricating oil with basic sulfonates or basic phenates, in combination with a dialkylthiophosphate. Sulfonates and phenates are used as alternatives, not mixtures.

U.S. Pat. No. 4,328,111 teaches a diesel lubricating oil with the reaction product of a basic compound (overbased metal sulfonate, phenate, or mixture thereof) with a phosphorus-containing material. The mixture of phonate and sulfonate is not discussed in the specification and is not found in the examples.

U.S. Pat. No. 4,938,881 teaches a diesel lubricating oil with a carboxylic dispersant, a salt of sulfonic or carboxylic acid, a dithiophosphoric acid, and a carboxylic ester derivative. It can also contain a salt of a sulfur acid, phosphorus acid, carboxylic acid, phenol, or mixtures thereof. The preferred salt is of an alkylated benzene sulfonic acid.

U.S. Pat. No. 5,071,576 teaches a mixture of overbased phenate and overbased alkyl aryl sulfonate. The sulfonate has at least one long chain alkyl group (greater than 40 carbon atoms). Up to 85% of the base can be contributed by the phenate.

U.S. Pat. No. 5,202,036, which is similar to U.S. Pat. No. 4,938,881, teaches a diesel lubricating oil with a carboxylic dispersant and a salt of acidic organic compound. The salt can be of sulfur acid, phosphorus acid, carboxylic acid, phenol, or mixtures thereof. The preferred salt is of an alkylated benzene sulfonic acid.

EP Patent Application 552892-A1 teaches a diesel lubricating oil with zinc dithiophosphate, an antioxidant, an overbased metal sulfurized phenate, and a metal alkyl aromatic sulfonate. Preferably, the phenate constitutes from 50 wt. % to 80 wt. % of the phenate/sulfonate, but the sulfonate is not overbased.

SUMMARY OF THE INVENTION

The present invention provides a lubricating oil composition having a major amount of an oil of lubricating viscosity, a minor amount of a carbonated sulfurized metal alkyl phenate, and a minor amount of a carbonated metal alkyl aryl sulfonate.

It is based in part on the discovery that the soot dispersancy of the composition is superior when the total base equivalents donated by the phenate is more than 85% of the total base equivalents donated by the phenate and sulfonate. Preferably, the total base equivalents donated by the phenate is at least 90% of the total base equivalents donated by the phenate and sulfonate.

Preferably, the carbonated sulfurized metal alkyl phenate is highly basic, with a total base number (TBN) of from 175 to 300, and a base ratio of metal to alkyl phenate of from 1.1:1 to 4:1. The molar ratio of carbonate to total metallic base is at least 0.4:1, preferably 0.5:1 to 0.75:1. The alkyl phenate portion of the molecule is derived from a monoalkylphenol, the alkyl group containing from about 9 to 28 carbon atoms.

Preferably, the carbonated metal alkyl aryl sulfonate is a carbonated magnesium sulfonate with a total base number of at least 175, most preferably 300 to 400, with a base ratio of metal to sulfonate of at least 8 1 and most preferably 11:1 to 35:1.

In one embodiment, the lubricating oil has a unique class of modified polyamino alkenyl or alkyl succinimide compounds prepared from the succinimide reaction product of (1) an alkenyl- or alkyl-substituted succinic anhydride derived from a polyolefin having a number average molecular weight (Mn) of about 2000 to about 2700 and a weight average molecular weight (Mw) to Mn ratio of about 1 to about 5; and (2) a polyalkylene polyamine having greater than 4 nitrogen atoms per mole. The modified succinimide of the present invention are obtained by post-treating the succinimide reaction product with a cyclic carbonate.

The carbonated sulfurized metal alkyl phenate, carbonated metal alkyl aryl sulfonate, and succinimide dispersant can be used in combination with a noncarbonated metal sulfonate, an oxidation inhibitor, a viscosity index improver; and a zinc dithiophosphate.

BRIEF DESCRIPTION OF THE DRAWINGS

To assist the understanding of this invention, reference will now be made to the appended drawings. The drawings are exemplary only, and should not be construed as limiting the invention.

The FIGURE is a graph of test data that shows the criticality on soot dispersion of the percentage of total base equivalents donated by the phenate relative to the total base equivalents donated by the phenate and sulfonate.

DETAILED DESCRIPTION OF THE INVENTION

In its broadest aspect, the present invention involves a lubricating oil composition having a major amount of an oil of lubricating viscosity, a minor amount of a carbonated sulfurized metal alkyl phenate, and a minor amount of a carbonated metal alkyl aryl sulfonate.

It is based in part on the discovery that superior soot dispersancy results are obtained when the total base equivalents donated by the phenate is more than 85% of the total base equivalents donated by the phenate and sulfonate. Preferably, the total base equivalents donated by the phenate is at least 90% of the total base equivalents donated by the phenate and sulfonate.

THE BASE OIL

The base oil used with the additive compositions of this invention may be mineral oil or synthetic oils of lubricating viscosity and preferably suitable for use in the crankcase of an internal combustion engine. The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl aryls of proper viscosity such as didodecyl benzene can be used. Useful synthetic esters include the esters of both monocarboxylic acids and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic aGids and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

While the examples cited below deal with heavy duty diesel engine oils, this invention is equally applicable to gasoline powered engines and the general class of internal combustion engines having a crankcase lubrication system.

CARBONATED SULFURIZED METAL ALKYL PHENATES

Preferably, the carbonated sulfurized metal alkyl phenate is highly basic, with a total base number of at least 175, most preferably 175 to 300, and a base ratio of metal to alkyl phenate of at least 1.1:1, most preferably 1.5:1 to 4:1. The molar ratio of carbonate to total metallic base is at least 0.4:1, preferably 0.5:1 to 0.75:1. The alkyl phenate portion of the molecule is derived from a monoalkyl phenol, the alkyl group containing from about 9 to 28 carbon atoms. The preferred metal is calcium. The alkyl group can be branched, linear, or mixtures thereof. Such a carbonated sulfurized metal alkyl phenate is disclosed by Walter W. Hanneman in U.S. Pat. No. 3,178,368, entitled "Process for Basic Sulfurized Metal Phenates," which is hereby incorporated by reference for all purposes.

CARBONATED METAL ALKYL ARYL SULFONATES

Preferably, the carbonated metal alkyl aryl sulfonate is also highly basic, with a total base number of at least 175, most preferably 300 to 400, with a base ratio of metal to sulfonate of at least 8:1 and most preferably 11:1 to 35:1. These slulfonates can be derived by sulfonating naturally occuring aromatics present in heavy base oils or by sulfonating alkylated aromatics. Such a carbonated metal alkyl aryl sulfonate is disclosed by T. C. Jao in U.S. Pat. No. 5,132,033, entitled "Methods for Preparing Overbased Calcium Sulfonates," which is hereby incorporated by reference for all purposes.

For our applications, the metal is preferably magnesium because magnesium sulfonate gives superior performance in the Sequence IID rust test, and gives a higher total base number per wt. % of sulfated ash.

MODIFIED POLYAMINO ALKENYL OR ALKYL SUCCINIMIDE

Modified polyamino alkenyl or alkyl succinimide useful in this invention are prepared by post-treating a polyamino alkenyl or alkyl succinimide with a cyclic carbonate. The polyamino alkenyl or alkyl succinimide are typically prepared by reaction of an alkenyl or alkyl succinic anhydride with a polyamine.

Alkenyl or alkyl succinimide are disclosed in numerous references and are well known in the art. Certain fundamental types of succinimide and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference. The term "succinimide" is understood in the art to include many of the amide, imide and amidine species that are also formed by this reaction. The predominant product, however, is succinimide and this term has been generally accepted as meaning the product of a reaction of an alkenyl- or alkyl-substituted succinic acid or anhydride with a polyamine.

THE SUCCINIC ANHYDRIDE REACTANT

A thermal process for the preparation of alkenyl- or alkyl-substituted succinic anhydride involving the reaction of a polyolefin and maleic anhydride has been described in the art. This thermal process is characterized by the thermal reaction of a polyolefin with maleic anhydride. Alternatively, the alkenyl- or alkyl-substituted succinic anhydride may be prepared as described in U.S. Pat. Nos. 4,388,471 and 4,450,281, which are incorporated herein by reference. Other examples of the preparation of alkenyl- or alkyl-substituted succinic anhydrides are taught in U.S. Pat. Nos. 3,018,250 and 3,024,195, which are incorporated herein by reference.

Preferably, the alkenyl or alkyl succinic anhydride reactant is derived from a polyolefin having an Mn from about 2000 to about 2700 and a Mw/Mn ratio of about 1 to about 5. In a preferred embodiment, the alkenyl or alkyl group of the succinimide has an Mn value from about 2100 to about 2400.

Suitable polyolefin polymers for reaction with maleic anhydride include polymers comprising a major amount of $C_2$ to $C_5$ monoolefin, e.g., ethylene, propylene, butylene, iso-butylene and pentene. The polymers can be homopolymers such as polyisobutylene as well as copolymers of two or more such olefins such as copolymers of: ethylene and propylene, butylene, and isobutylene, etc. Other copolymers include those in which a minor amount of the copolymer monomers, e.g., 1 to 20 mole percent, is a $C_4$ to $C_8$ diolefin, e.g., a copolymer of isobutylene and butadiene or a copolymer of ethylene, propylene and 1,4-hexadiene, etc.

A particularly preferred class of olefin polymers for reaction with maleic anhydride comprises the polybutenes, which are prepared by polymerization of one or more of 1-butene, 2-butene and isobutene.

Especially desirable are polybutenes containing a substantial proportion of units derived from isobutene. The polybutene may contain minor amounts of butadiene, which may or may not be incorporated in the polymer. These polybutenes are readily available commercial materials well known to those skilled in the art. Disclosures thereof will be found, for example, in U.S. Pat. Nos. 3,215,707; 3,231,587; 3,515,669; 3,579,450; and 3,912,764, as well as U.S. Pat. Nos. 4,152,499 and 4,605,808. The above are incorporated by reference for their disclosures of suitable polybutenes.

Suitable succinic anhydride reactants also include copolymers having alternating polyalkylene and succinic groups, such as those taught in U.S. Pat. No. 5,112,507, which is hereby incorporated by reference.

THE POLYAMINE REACTANT

The polyamine to be reacted with the alkenyl or alkyl succinic anhydride to produce the polyamino alkenyl or alkyl succinimide employed in this invention is generally a polyalkylene polyamine. Preferably, the polyalkylene polyamine has an average nitrogen atom to molecule ratio of greater than 4.0, up to a maximum of about 12. Most preferred are polyamines having an average nitrogen atom to molecule ratio of from about 5 to about 7.

Preferred polyalkylene polyamines also contain from about 4 to about 40 carbon atoms, there being preferably from 2 to 3 carbon atoms per alkylene unit. The polyamine preferably has a carbon-to-nitrogen ratio of from about 1:1 to about 10:1.

Methods of preparation of polyamines and their reactions are detailed in Sidgewick's "The Organic Chemistry of Nitrogen," Clarendon Press, Oxford, 1966; Noller's "Chemistry of Organic Compounds," Saunders, Philadelphia, 2nd Ed., 1957; and Kirk-Othmer's "Encyclopedia of Chemical Technology," 2nd Ed., especially Volume 2, pp. 99–116.

The reaction of a polyamine with an alkenyl or alkyl succinic anhydride to produce polyamino alkenyl or alkyl succinimide is well known in the art and is disclosed in U.S. Pat. Nos. 2,992,708; 3,018,291; 3,024,237; 3,100,673; 3,219,666; 3,172,892 and 3,272,746. The above are incorporated herein by reference for their disclosures of preparing alkenyl or alkyl succinimide.

Generally, a suitable molar charge of polyamine to alkenyl or alkyl succinic anhydride for making the compounds of this invention is from about 0.35:1 to about 0.6:1; although preferably from about 0.4:1 to about 0.5:1. As used herein, the phrase "molar charge of polyamine to alkenyl or alkyl succinic anhydride" means the ratio of the number of moles of polyamine to the number of moles of succinic groups in the succinic anhydride reactant.

POST-TREATMENT OF THE POLYAMINO ALKENYL OR ALKYL SUCCINIMIDE WITH A CYCLIC CARBONATE

The polyamino alkenyl or alkyl succinimide formed as described above are then reacted with a cyclic carbonate. The resulting modified polyamino alkenyl succinimide has one or more nitrogens of the polyamino moiety substituted with a hydroxy hydrocarbyl oxycarbonyl, a hydroxy poly (oxyalkylene) oxycarbonyl, a hydroxyalkylene, hydroxyalkylenepoly(oxyalkylene), or mixture thereof.

The reaction of a polyamino alkenyl or alkyl succinimide with a cyclic carbonate is conducted at a temperature sufficient to cause reaction of the cyclic carbonate with the polyamino alkenyl or alkyl succinimide. In particular, reaction temperatures of from about 20° C. to about 250° C. are preferred with temperatures of from about 100° C. to 200° C. being more preferred and temperatures of from 150° C. to 180° C. are most preferred.

The reaction may be conducted neat, wherein both the alkenyl or alkyl succinimide and the cyclic carbonate are combined in the proper ratio, either alone or in the presence of a catalyst (such as an acidic, basic or Lewis acid catalyst), and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed, it is preferably inert to the reactants and products formed and is generally used in an amount sufficient to insure efficient stirring.

ZINC DITHIOPHOSPHATE

The general methods for preparing the dithiophosphoric acid esters and their corresponding metal salts are described in U.S. Pat. Nos. 3,089,850, 3,102,096, 3,293,181 and 3,489,682, which are all incorporated by reference for all purposes. Preferably, 100% of the zinc dithiophosphate is derived from secondary alcohols. It is thought that the zinc dithiophosphate is instrumental in producing better oxidation stability and improved anti-wear properties.

Examples of metal compounds that may be reacted with the dithiophosphoric acid to produce zinc dithiophosphate include zinc oxide, zinc hydroxide, zinc carbonate, and zinc propylate.

The total amount of the zinc dithiophosphate present is in the range of 3 to 30, preferably 10 to 20, millimoles of zinc per kilogram of finished product. The reason for this range is that less than 10 mm/kg could easily result in failing valve train wear performance, while greater than 20 mm/kg leads to the concern of phosphorus poisoning of the catalytic converters.

OTHER ADDITIVES

Other additives that may be present in the lubricating oil composition include oxidation inhibitors, extreme pressure additives, friction modifiers, rust inhibitors, foam inhibitors, corrosion inhibitors, metal deactivators, pour point depressants, antioxidants, wear inhibitors, viscosity index improvers, deposit inhibitors, and a variety of other well-known additives.

EXAMPLES

The invention will be further illustrated by the following examples, which set forth particularly advantageous method embodiments. While the Examples are provided to illustrate the present invention, they are not intended to limit it.

While the examples cited below deal with heavy duty diesel engine oils, this invention is equally applicable to gasoline powered engines and the general class of internal combustion engines having a crankcase lubrication system.

Comparative Example 1

A heavy duty diesel lubricating oil composition was blended as a 7 TBN oil as described below. Whereas a conventional commercial oil might contain from 0.25 to 0.75 wt. % of rust inhibitor, the examples below were formulated without rust inhibitor to illustrate the advantages of the present invention.

| Component | wt. % | Base Equivalents |
|---|---|---|
| sulfurized carbonated metal phenate (250 TBN, 1.9:1 base ratio) | 2.1 | 50 |
| polyamino alkenyl or alkyl succinimide | 5.5 | |
| low overbased calcium sulfonate | 1.6 | |
| zinc dithiophosphate | 1.4 | |
| molybdenum inhibitor | 0.2 | |
| viscosity index improver | 7.0 | |
| Base oil | Balance | |

Example 2

A second lubricating oil composition was blended as a 7 TBN oil as in Example 1 with the exception that a portion of the sulfurized carbonate metal phenate was replaced with carbonated magnesium alkylsulfonate such that the magnesium sulfonate accounted for 10% of the total base equivalents supplied by the carbonated detergent as described below:

| Component | wt. % | Base Equivalents |
|---|---|---|
| sulfurized carbonated metal phenate | 1.9 | 45 |
| carbonated magnesium alkylsulfonate (400 TBN, 15:1 base ratio) | 0.13 | 5 |

Examples 3 Through 7

Additional lubricating oil compositions were blended as in Example 2 above with the exception that the relative amounts of sulfurized carbonated metal phenate and carbonated magnesium alkylsulfonate were varied as follows:

| Example | wt. % | Phenate Equivalents | % metal base | wt. % | Sulfonate Equivalents | % metal base |
|---|---|---|---|---|---|---|
| 3 | 2.0 | 47.5 | 95 | 0.065 | 2.5 | 5 |
| 4* | 1.8 | 42.5 | 85 | 0.195 | 7.5 | 15 |
| 5* | 1.7 | 40 | 80 | 0.26 | 10 | 20 |
| 6* | 1.6 | 37.5 | 75 | 0.325 | 12.5 | 25 |
| 7* | 1.05 | 25 | 50 | 0.65 | 25 | 50 |

*Note that Examples 4 through 7 are comparative examples.

Example 8

Soot Dispersancy

In this example, the formulations in Examples 1 through 7 were evaluated in a dispersancy bench test. The test provides a rapid means for determining an oil's ability to control viscosity increase due to soot loading. In this test, carbon black is added to the finished oil. The mixture is well mixed and degassed in a vacuum oven. The viscosity of the oil is measured at 100° C. before and after the addition of the carbon black. Oils with poor dispersancy will exhibit a higher viscosity increase due to the agglomeration of the carbon black in the oil.

In this test, differences in viscosity increase of 5% are considered to be significant at the 95% confidence level. The results are summarized in the table below:

| | % metal base from phenate | Average % viscosity increase |
|---|---|---|
| Example 1 | 100% | 155 |
| Example 3 | 95% | 159 |
| Example 2 | 90% | 155 |
| Example 4 | 85% | 171 |
| Example 5 | 80% | 168 |
| Example 6 | 75% | 162 |
| Example 7 | 50% | 167 |

The Figure is a graph of this test data. Note that there is a substantial improvement in soot dispersancy when the phenate constitutes more than 85% of the metal base.

Example 9

Rust Inhibition

In this example, the formulations in examples 1 through 4 were evaluated in a modified D665 rust bench test. This test is designed to evaluate an oil's ability to inhibit rust formation in crankcase internal combustion engines. In this test, the oil is placed in a stirred beaker heated to 80 C. A previously cleaned metal coupon is suspended in the oil, and a sufficient amount of dilute (0.2N) aqueous hydrochloric acid is added to neutralize all of the base present in the oil. The oil-dilute acid mixture is then stirred for 7 hours at 80 C, at which point the stirrer is stopped and the metal coupon removed.

The coupon was rinsed free of oil using heptane and placed in a dessicator until ready to be rated. The coupon was rated using the CRC rust and varnish rating scale. In this scale, 10 was absolutely clean, and 0 was 100% covered by rust. Four oils were tested and rated with the results below:

| Example | % metal from phenate | Rust rating (10 = clean) |
|---|---|---|
| 1 | 100 | 8.26 |
| 3 | 95 | 8.76 |
| 2 | 90 | 8.6 |
| 4 | 85 | 8.8 |

Thus we see an improvement in rust inhibition as evidenced by the improvement in rust rating with increasing levels of magnesium sulfonate.

While the present invention has been described with reference to specific embodiments, this application is intended to cover those various changes and substitutions that may be made by those skilled in the art without departing from the spirit and scope of the appended claims.

What is claimed is:

1. A lubricating oil composition comprising:

(a) a major amount of an oil of lubricating viscosity;

(b) a minor amount of a carbonated sulfurized metal alkyl phenate and;

(c) a minor amount of a carbonated metal alkyl aryl sulfonate, wherein the total base equivalents donated by the phenate is more than 85% of the total base equivalents donated by the phenate and sulfonate;

(d) a minor amount of a polyamino alkenyl or alkyl succinimide wherein the succinimide comprises the reaction product of:

(a) an alkenyl- or alkyl-substituted succinic anhydride derived from a polyolefin having a Mn of from 2000 to 2700 and a Mw/Mn ratio of from 1 to 5; and (b) a polyalkylene polyamine having an average nitrogen atom to molecule ratio of greater than 4.0;

wherein the reaction product is post-treated with a cyclic carbonate.

2. A lubricating oil composition according to claim 1 wherein the charge mole ratio of polyamine to succinic anhydride is from 0.35:1 to 0.6:1; and the charge mole ratio of cyclic carbonate to basic amine nitrogen in the reaction product is from 1.5:1 to 4:1.

3. A lubricating oil composition according to claim 1 wherein the polyolefin has a Mn of from 2100 to 2400.

4. A lubricating oil composition according to claim 1 wherein the polyalkylene polyamine has an average nitrogen atom to molecule ratio of from 5 to 7.

5. A lubricating oil composition comprising:

(a) a major amount of an oil of lubricating viscosity;

(b) a minor amount of a carbonated sulfurized calcium alkyl phenate;

(c) a minor amount of a carbonated magnesium alkyl aryl sulfonate, wherein the total base equivalents donated by the phenate is more than 85% of the total base equivalents donated by the phenate and sulfonate;

(d) a minor amount of a noncarbonated metal alkyl aryl sulfonate (e) a minor amount of a polyamino alkenyl or alkyl succinimide, wherein the amount of the succinimide is less than about 3 weight percent on a dry polymer basis, and wherein the succinimide comprises the reaction product of:

(i) an alkenyl- or alkyl-substituted succinic anhydride derived from a polyisobutene having a Mn of from 2100 to 2400 and a Mw/Mn ratio of from 1 to 5; and (ii) a polyalkylene polyamine having an average nitrogen atom to molecule ratio of greater than 4; wherein the charge mole ratio of polyamine to succinic anhydride is from 0.4:1 to 0.5:1;

wherein the reaction product is post-treated with ethylene carbonate at a charge mole ratio of ethylene carbonate to basic amine nitrogen in the succinimide reaction product of from 2:1 to 3:1;

(f) a minor amount of an oxidation inhibitor;

(g) a minor amount of a viscosity index improver; and (h) a minor amount of a zinc dithiophosphate.

* * * * *